United States Patent [19]

Ehlers

[11] 4,236,754

[45] Dec. 2, 1980

[54] PILLOW FOR RECLINER CHAIR

[76] Inventor: Eugene J. Ehlers, 9 Enchanting Blvd., Naples, Fla. 33942

[21] Appl. No.: 947,843

[22] Filed: Oct. 2, 1978

[51] Int. Cl.[3] ..... A47C 7/50; A47C 23/00

[52] U.S. Cl. ..... 297/423; 5/443; 297/68; 297/111

[58] Field of Search ..... 5/345 R, 361 B; 297/68, 297/111, 423, 428

[56] References Cited

U.S. PATENT DOCUMENTS

| | | | |
|---|---|---|---|
| 2,377,649 | 6/1945 | Quinney | 297/68 |
| 2,543,218 | 2/1951 | Young et al. | 5/447 R |
| 2,663,354 | 12/1953 | Bell | 297/111 |
| 3,389,411 | 6/1968 | Emery | 5/490 R X |

*Primary Examiner*—James T. McCall

[57] ABSTRACT

A leg support pillow for use on a recliner chair of the type having an extendible leg rest with a pad on the terminal end which is spaced from a chair seat cushion when the leg rest is extended, defining a space between the leg rest pad and the seat cushion, a leg support pillow having an upper surface sized to span the distance between the leg rest and the seat cushion and including a downwardly extending body sized to snugly nest between the leg rest pad and seat cushion and having therein a laterally extending rigid reinforcing sheet sandwiched between an upper and lower body portion of compressible material encased within an outer pillowcase.

1 Claim, 4 Drawing Figures

PILLOW FOR RECLINER CHAIR

FIELD OF THE INVENTION

This invention relates to a pillow for use with a recliner type chair and, more particularly, to a pillow sized for insertion between the face of the seat cushion and the leg rest pad, when the leg rest of the recliner chair is extended; the pillow is composed of a compressible body encased in a jacket, and it is adapted to be nested between the leg rest pad and the face of the seat cushion.

BACKGROUND OF THE INVENTION

In the past there have been numerous types of recliner chairs and, as is perhaps well known, when the leg rest is extended, there is a substantial distance between the leg rest pad and the seat cushion proper with the result that a person sitting in the chair with the leg rest extended is not supported along that portion of the legs which extends between the seat cushion and the leg rest pad. This invention is of a pad of compressible rubbery material jacketed in an outer casing which pillow is sized for insertion between the leg rest pad and the seat cushion to support the full length of the legs.

It is, generally speaking, an object of this invention to provide an improved pillow for use with a recliner chair which is sized to be received between the leg rest pad and the forward face of a recliner chair seat cushion which pillow is compressible so as to be snugly received within the space and to support the legs of a user along the entire length.

In accordance with these and other objects which will become apparent hereinafter, the instant invention will now be described with reference to the accompanying drawings, in which:

DESCRIPTION OF THE DRAWINGS

Figure 1:
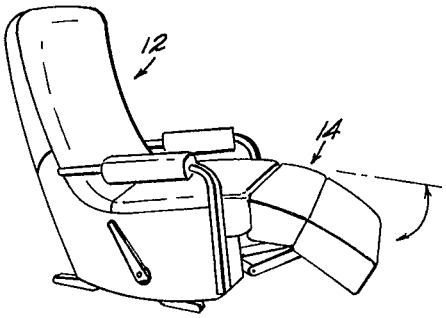
FIG. 1 is a perspective view illustrating the instant invention installed on a recliner chair.
Figure 2:
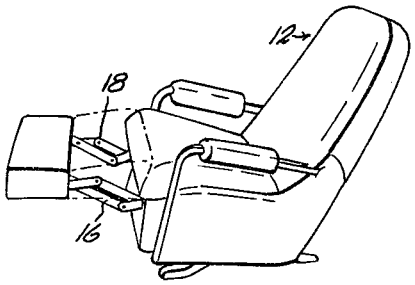
FIG. 2 is a view similar to FIG. 1 with the chair removed.
Figure 3:
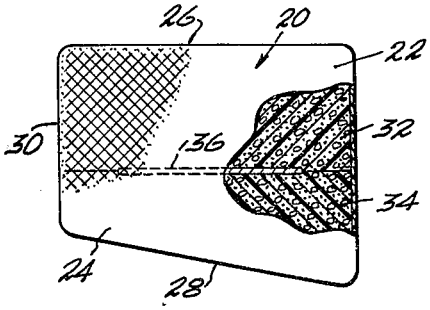
FIG. 3 is a view of the instant invention removed from the chair of FIG. 2.
Figure 4:
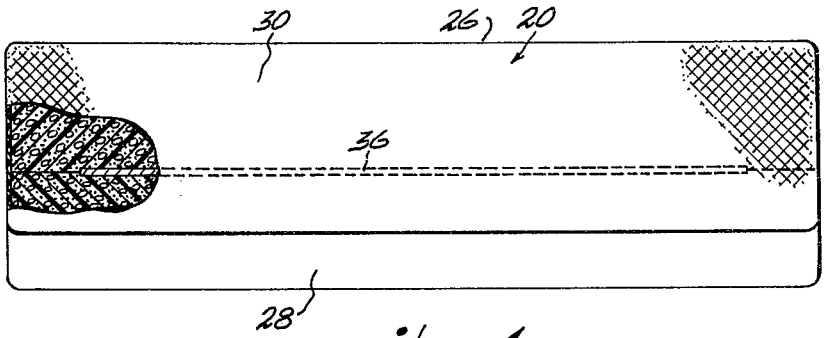
FIG. 4 is an enlarged left-side elevation view illustrating the invention shown in FIG. 2.

Referring to the drawings where like reference characters designate like or corresponding parts throughout the seven views and referring particularly to FIG. 1, there is shown a recliner chair 12 of the conventional commercially available type which includes a leg rest which is supported on extendable arms 16 and 18 when the leg rest is extended as shown in the drawings. The invention comprises a pillow 14 which is receivable between the seat cushion and the extended foot rest. As shown in FIG. 3, the pillow includes a body 20 composed of an upper portion 22 and a lower portion 24 with a reinforcing or load distibution means in the form of a plywood board 36 sandwiched therebetween and extending medially toward but not to the opposite side edges 30 and 32 between an upper surface 26 and a lower surface 28. Each of the pillow portions is of rubbery or sponge material and is exteriorly covered as at

20 and 24 by an outer casing material which may be of plastic.

The pillow is sized for insertion between the seat cushion and leg rest pad as shown. In the preferred embodiment illustrated the distance across the upper surface 26 between the opposite side edges 30 and 32 is about 8½ inches while the lateral distance between the end faces is about 22 inches. This comports with the size of the space between the leg rest pad and the seat cushion of a conventional recliner chair sometimes referred to as the Lazy Boy Recliner. There is thus defined a leg rest support area of dimensions of about 22 inches by 8½ inches. The height of the longer side 32, which is generally perpendicular to the upper edge previously described is about 6½ inches while the opposite side 30 is about 5 inches in perpendicular relationship. The lower surface joins the side surfaces as shown and as indicated by the numeral 28. Preferably a reinforcing or load-distribution means in the form of a plywood sheet 36 is embedded between the two portions at about 3½ inches below the upper surface 26. The two portions, the upper portion 22 and the lower portion 24, are sandwiched about the plywood member, which is preferably 3-ply or ¼ inch plywood and of a dimension of about 5×18 inches. The sheet is centered between the confronting surfaces of the pillow body portions which are cemented together with contact type cement. Any polyfoam core may be utilized for the body portions. The body of the pillow is inserted into the outer casing material or pillowcase in a somewhat compressed condition. In the preferred embodiment the casing is somewhat smaller than the dimensions of the normal size of the pillow body. In the preferred embodiment the pillow casing is about 21 inches by 7½ inches by 5 inches on the back side and 4 inches on the front side. By compressing the core or body into a smaller size, more rigidity and, hence, better support is achieved.

What is claimed is:

1. For use with a recliner chair of the type having a seat cushion with a forward face and a leg pad adapted to be moved into spaced relation from the seat cushion when the chair is in a reclining position with a leg pad face spaced from the seat cushion face a predetermined distance, a pillow comprising a body having an upper surface of a length slightly greater than the distance between the confronting faces of the seat cushion and leg rest pad and said pillow comprising a body of compressible material jacketed within an outer casing;

said body includes an upper portion and a lower portion and a reinforcing means in the form of a rigid sheet embedded between said upper and lower portions;

said pillow includes an inner face adapted to confront the seat cushion face and an outer face adapted to confront the leg rest face and the distance between said pillow face is somewhat greater than the predetermined distance and wherein one of said faces of said pillow and cushion is longer than the other face, the width of said reinforcing means being less than the distance between said inner face and said outer face;

said body being of rubbery material;

said upper surface beging about 22 inches by 8½ inches; and said outer case being foreshortened with respect to the normal dimensions of said cushion, whereby said cushion is compressed when inserted.

* * * * *